US012680699B2

(12) United States Patent
Luo et al.

(10) Patent No.: US 12,680,699 B2
(45) Date of Patent: Jul. 14, 2026

(54) COOKING DEVICE

(71) Applicants: GUANGDONG GALANZ MICROWAVE ELEC APPL MANF CO, LTD., Zhongshan (CN); GUANGDONG GALANZ ENTERPRISES CO., LTD., Foshan (CN)

(72) Inventors: Jianying Luo, Zhongshan (CN); Lebiao Xie, Zhongshan (CN)

(73) Assignees: GUANGDONG GALANZ MICROWAVE ELEC APPL MANF CO, LTD., Zhongshan (CN); GUANGDONG GALANZ ENTERPRISES CO., LTD., Foshan (CN)

( * ) Notice: Subject to any disclaimer, the term of this patent is extended or adjusted under 35 U.S.C. 154(b) by 784 days.

(21) Appl. No.: 17/966,951

(22) Filed: Oct. 17, 2022

(65) Prior Publication Data

US 2023/0280041 A1 Sep. 7, 2023

(30) Foreign Application Priority Data

Mar. 4, 2022 (CN) ..... 202220482807.3
Jul. 4, 2022 (CN) ..... 202210778681.9

(51) Int. Cl.
*F24C 15/02* (2006.01)

(52) U.S. Cl.
CPC ..... *F24C 15/022* (2013.01)

(58) Field of Classification Search
CPC ..... F24C 15/022; H05B 6/6417
(Continued)

(56) References Cited

U.S. PATENT DOCUMENTS

2018/0163443 A1* 6/2018 Park ..... E05D 11/00
2019/0264925 A1* 8/2019 Lin ..... E05B 1/0038

FOREIGN PATENT DOCUMENTS

CN 203757794 U * 8/2014 ..... F24C 15/02
CN 106121393 A * 11/2016 ..... E05B 65/0858
(Continued)

OTHER PUBLICATIONS

Alkaios Varotsis, 14 proven design tips to reduce the cost of CNC machining, 19 pages, https://www.hubs.com/knowledge-base/reducing-cnc-machining-costs-design-tips/ (Year: 2021).*
(Continued)

*Primary Examiner* — Michael G Hoang
*Assistant Examiner* — Elizabeth Ann Laughlin
(74) *Attorney, Agent, or Firm* — Taft, Stettinius & Hollister LLP

(57) ABSTRACT

A cooking device includes: a box body provided with a buckle; a door body rotatably connected to the box body, and wherein the door body is provided with a door hook that is snap-fitted with the buckle, the door hook is movable relative to the door body, and has a first position and a second position, wherein when the door hook is snap-fitted with the buckle, the door hook is in the first position; and a switch assembly arranged on the box body and including a first button, a second button, and a blocking member. The blocking member is capable of being moved relative to the first button and/or the second button, and has a blocking position and an avoiding position. The first button is configured to drive the blocking member to move from the blocking position to the avoiding position.

18 Claims, 12 Drawing Sheets

(58) Field of Classification Search
USPC ..... 126/19 R
See application file for complete search history.

(56) References Cited

FOREIGN PATENT DOCUMENTS

| | | | | | |
|---|---|---|---|---|---|
| CN | 207101012 | U | | 3/2018 | |
| CN | 110189935 | A | | 8/2019 | |
| CN | 211961818 | U | | 11/2020 | |
| CN | 211976950 | U | | 11/2020 | |
| CN | 212281062 | U | | 1/2021 | |
| CN | 212565908 | U | * | 2/2021 | ..... E05C 19/12 |
| CN | 215820576 | U | | 2/2022 | |

OTHER PUBLICATIONS

Chinese to English machine translation of CN 106121393 A.*
Chinese to English machine translation of CN 211976950 U.*
Chinese to English machine translation of CN 212565908 U.*
Chinese Patent Office, Office Action issued in corresponding Application No. 202210778681.9, dated Aug. 23, 2025, 9 pp.

* cited by examiner

COOKING DEVICE

CROSS-REFERENCE TO RELATED APPLICATIONS

The present application claims priorities to Chinese Patent Application No. 2022204828073 filed on Mar. 4, 2022, and Chinese Patent Application No. 2022107786819 filed on Jul. 4, 2022, the contents of which are incorporated herein by reference in their entireties.

TECHNICAL FIELD

The present disclosure relates to the technical field of household appliances, in particular to a cooking device.

BACKGROUND

Conventional cooking appliances, such as microwave ovens, ovens, etc. generally have a hand-pull door or a button-type door. In the process of opening the door, a user can open the door in one step by pulling a door handle or pressing an opening button. Therefore, the conventional cooking appliances are likely to cause the case where children may open the door accidentally such that the high-temperature gas or food in the cooking appliances may scald children, posing a potential safety hazard.

SUMMARY

According to various embodiments, a cooking device is provided.

In an aspect of the present disclosure, a cooking device is provided, and includes:

a box body provided with a buckle;

a door body rotatably connected to the box body, and wherein the door body is provided with a door hook that is snap-fitted with the buckle, the door hook is movable relative to the door body, and has a first position and a second position; when the door hook is snap-fitted with the buckle, the door hook is in the first position; when the door hook is moved from the first position to the second position, the door hook is separated from the buckle; and a switch assembly arranged on the box body and including a first button, a second button, and a blocking member; the blocking member being capable of being moved relative to the first button and/or the second button, and having a blocking position and an avoiding position; the first button being configured to drive the blocking member to move from the blocking position to the avoiding position, wherein the second button has an initial position and an opening position. When the blocking member is in the avoiding position, the second button is capable of being moved from the initial position to the opening position. The second button exerts force on the door hook and drives the door hook to move from the first position to the second position; and when the blocking member is in the blocking position, the blocking member is configured to prevent the second button from moving from the initial position to the opening position.

In the above cooking device, the door body is rotatable relative to the box body and approaches the box body, and the box body is in a closed state through the snap-fit of the door hook and the buckle. In this case, the door hook is in the first position relative to the door body. When it is necessary to open the cooking device, the first button is used to drive the blocking member to move from the blocking position to the avoiding position. In this case, the blocking member will not block the movement of the second button, and the second button can be moved relative to the box body from the initial position to the opening position. The second button can drive the door hook to move from the first position to the second position. When the door hook is in the second position, the door hook is separated from the buckle. In this case, the door body can be separated from the box body. However, if only the second button is operated, the second button cannot be moved from the initial position to the opening position because the blocking member is still in the blocking position, so that the door hook cannot be driven to move to the second position. If only the first button is operated, the door hook cannot be driven to move either. Therefore, when the above-mentioned cooking device needs to be opened, the first button needs to be operated firstly, to drive the blocking member to move, and then the second button is operated to drive the door hook to move, which requires two-step operations to cooperate to open the cooking device, so that children can be prevented from accidentally opening the cooking device and the security in use can be improved.

In one of the embodiments, the box body includes a control box. The blocking member is provided with a first through hole through which the first button passes, and a second through hole through which the second button passes. A first pressing portion is arranged on a side of the first button. When the first button passes through the first through hole, the first pressing portion contacts a hole wall of the first through hole, and exerts force on the blocking member, so that the blocking member is moved from the blocking position to the avoiding position. When the blocking member is in the avoiding position, the second button is capable of passing through the second through hole, and exerting force on the door hook, so that the door hook is moved from the first position to the second position. When the blocking member is in the blocking position, the blocking member is configured to prevent the second button from passing through the second through hole.

In one of the embodiments, the control box is provided with a button groove. The first button includes a first pressing plate and a first sliding rod. The second button includes a second pressing plate and a second sliding rod. The first pressing plate and the second pressing plate are both arranged in the button groove, and are capable of sliding in a depth direction of the button groove. The second sliding rod is capable of extending through a rear wall of the button groove, and extending into the box body. The blocking member is arranged on a wall of the button groove.

In one of the embodiments, the first pressing portion is arranged on a side of the first sliding rod, and a second pressing portion is arranged on a side of the second sliding rod. When the blocking member is in the blocking position, the second pressing portion is not capable of passing through the second through hole. When the blocking member is in the avoiding position, the second sliding rod and the second pressing portion are capable of passing through the second through hole, and the second sliding rod exerts force on the door hook and drives the door hook to move from the first position to the second position.

In one of the embodiments, the control box is further provided with a rotating member. A first stroke hole and a second stroke hole are arranged on the rear wall of the button groove. The first stroke hole and the second stroke hole are used in cooperation with the first sliding rod and the second sliding rod, respectively. The second sliding rod extends out of the second stroke hole and pushes the rotating member at a position of a maximum stroke, so that the rotating member directly or indirectly exerts force on the door hook, and drives the door hook to move from the first position to the second position.

In one of the embodiments, a first limiting portion and a second limiting portion are arranged on a sidewall of the button groove. The first limiting portion is configured to limit a stroke of the first pressing plate, and the second limiting portion is configured to limit a stroke of the second pressing plate.

In one of the embodiments, an abutting portion is arranged on a side of the first pressing plate close to the first sliding rod; the abutting portion is configured to contact a bottom surface of the button groove or the blocking member.

In one of the embodiments, guide holes are arranged on two opposite sidewalls of the button groove. Two ends of the blocking member extend through two guide holes, respectively.

In one of the embodiments a rotating shaft is arranged at a side of the rear wall of the button groove close to the box body. The blocking member is rotatably arranged on the rotating shaft.

In one of the embodiments, the switch assembly further includes a first elastic member. Two ends of the first elastic member are respectively connected to the blocking member and the control box. The first elastic member is configured to move the blocking member from the avoiding position to the blocking position. The blocking member slidably cooperates with the control box. The blocking member is capable of reciprocating and translating relative to the control box between the blocking position and the avoiding position.

In one of the embodiments, the blocking member rotatably cooperates with the control box; the blocking member is capable of reciprocating and rotating relative to the control box between the blocking position and the avoiding position.

In one of the embodiments, a first sliding portion is arranged on a sidewall of the button groove, and a second sliding portion is arranged on the first pressing plate. One of the first sliding portion and the second sliding portion is a first guide rail, and the other of the first sliding portion and the second sliding portion is a first guide groove that slidably cooperates with the first guide rail.

In one of the embodiments, a third sliding portion is arranged on the sidewall of the button groove, and a fourth sliding portion is arranged on the second pressing plate. One of the third sliding portion and the fourth sliding portion is a second guide rail, and the other of the third sliding portion and the fourth sliding portion is a second guide groove that slidably cooperates with the second guide rail.

In one of the embodiments, a third through hole is arranged on the blocking member. A second hook portion is arranged on the second sliding rod. The second hook portion is configured to be used in cooperation with the third through hole. When the blocking member is in the blocking position and the second button is pressed, the second hook portion is inserted into the third through hole, to block the second button from moving from the initial position to the opening position. When the blocking member is moved to the avoiding position, the second sliding rod and the second hook portion are capable of passing through the second through hole.

In one of the embodiments, the switch assembly further includes a resilient member. Two ends of the resilient member abut against the first button and the control box, respectively. A first hook portion is arranged on the first pressing portion of the first button. When the first button passes through the first through hole, the resilient member is pressed; after passing through the first through hole, the first hook portion abuts against a side surface of the blocking member under a restoring force of the resilient member, to stop the first button. The second pressing portion is arranged on a side of the second button. When the second button is moved from the initial position to the opening position, and passes through the second through hole, the second pressing portion presses a hole wall of the second through hole, so that the blocking member is moved in a direction from the blocking position to the avoiding position. When the first through hole is moved to a position opposite to the first hook portion, the blocking member releases stopping effect on the first button.

In one of the embodiments, the switch assembly further includes a second elastic member. Two ends of the second elastic member are connected to the door body and the door hook, respectively. The second elastic member is configured to move the door hook from the second position to the first position. When the second button is moved from the initial position to the opening position, the second button pushes the rotating member to rotate; the rotating member directly or indirectly pushes the door hook to move from the first position to the second position.

BRIEF DESCRIPTION OF THE DRAWINGS

The accompanying drawings constituting a part of the present disclosure are used to provide further understanding of the present disclosure, and exemplary embodiments of the present disclosure and the descriptions thereof are used to illustrate the present disclosure and do not constitute an improper limitation of the present disclosure.

In order to illustrate the technical solutions in the embodiments of the present disclosure more clearly, the accompanying drawings used in the description of the embodiments are briefly introduced below. Apparently, the accompanying drawings in the following description are only some embodiments of the present disclosure. For those of ordinary skill in the art, other drawings can also be obtained from these drawings without creative effort.

ILLUSTRATION FOR REFERENCE SIGNS

Figure 1:
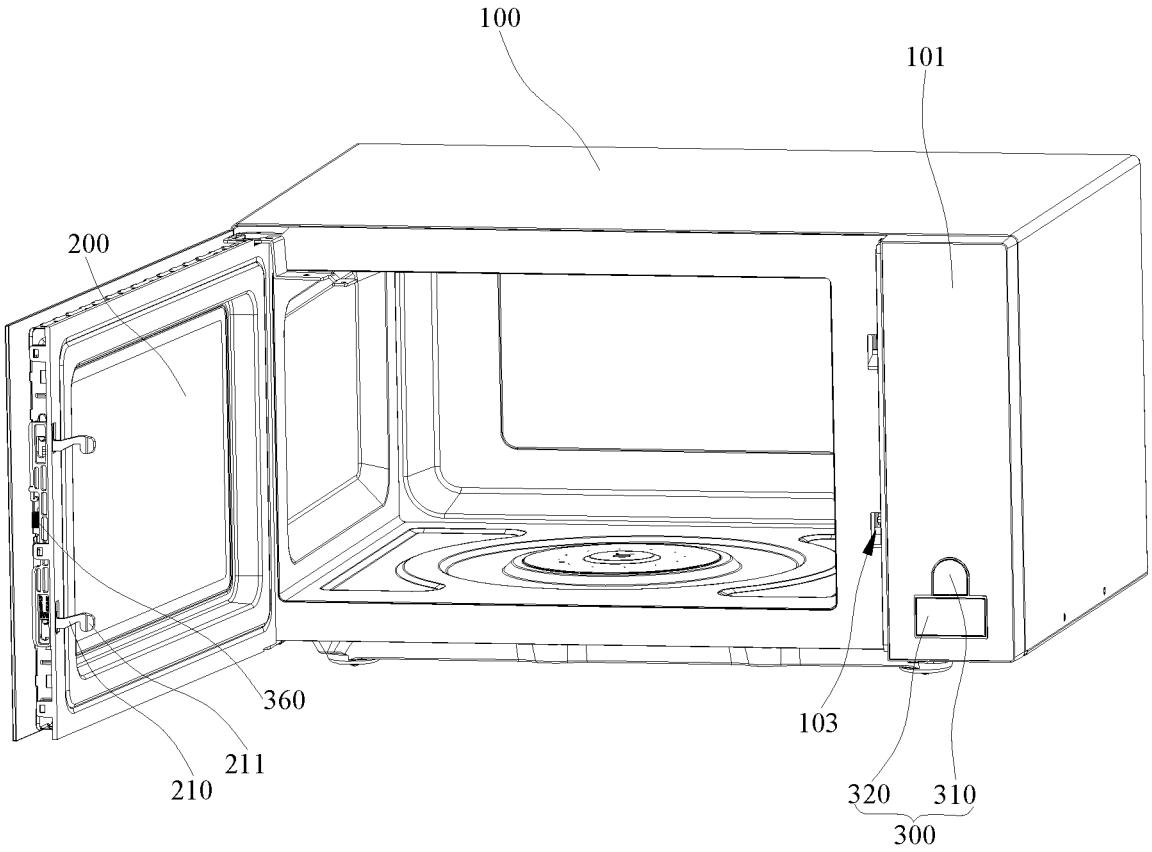
FIG. 1 is a schematic view of a cooking device according to an embodiment of the present disclosure.
Figure 2:
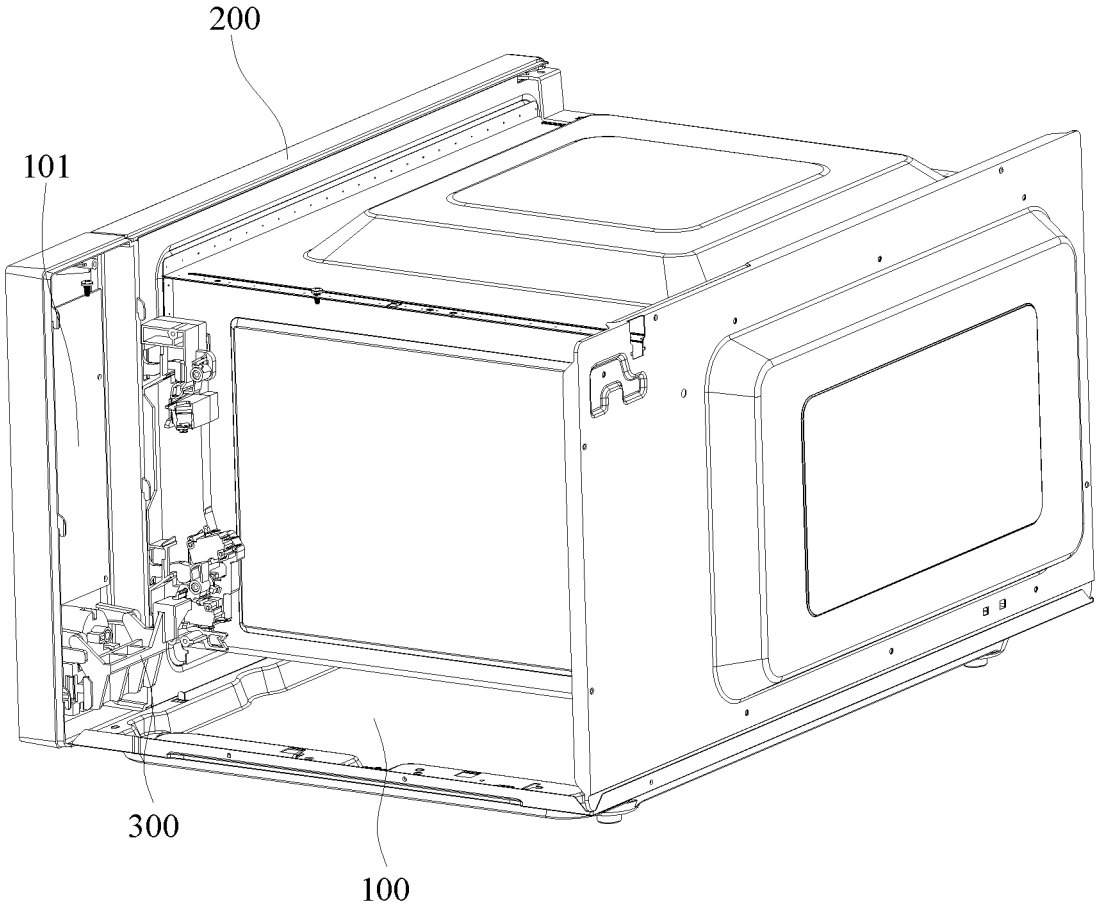
FIG. 2 is a view showing part of inner structure of a cooking device according to an embodiment of the present disclosure.
Figure 3:
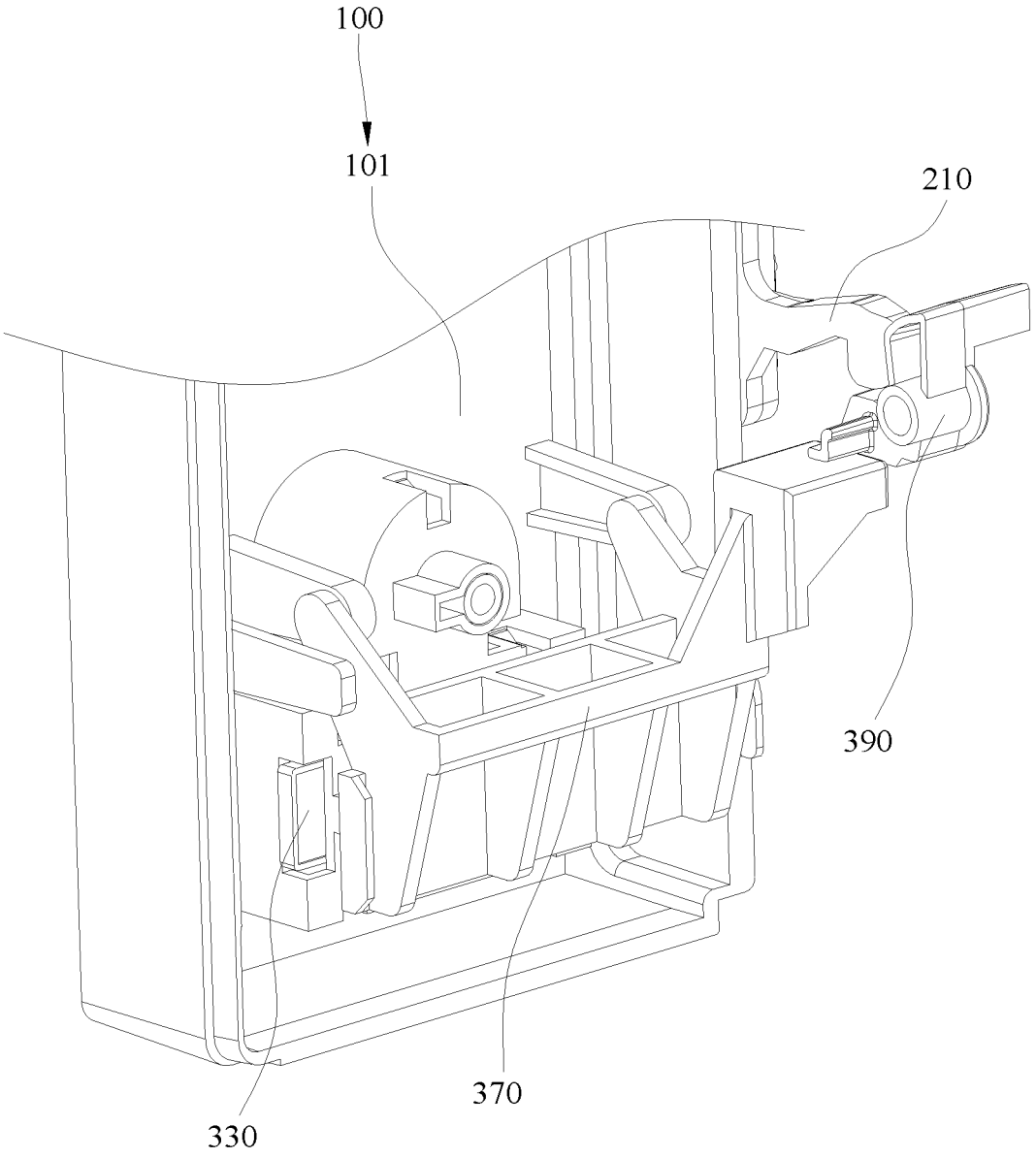
FIG. 3 is a schematic view of a box body, a door hook, and part of a switch assembly that are assemble together according to an embodiment of the present disclosure.

100, box body; 101, control box; 101*a*, button groove; 101*aa*, rear wall; 101*b*, first stroke hole; 101*c*, second stroke hole; 102, guide hole; 103, insertion opening; 110, buckle; 120, first limiting portion; 130, second limiting portion; 140, first guide rail; 200, door body; 210, door hook; 211, hook-shaped portion; 300, switch assembly; 310, first button; 310*a*, first pressing plate; 310*b*, first sliding rod; 310*c*, first guide groove; 311, first pressing portion; 311*a*, first contact surface; 312, first hook portion; 320, second button; 320*a*, second pressing plate; 320*b*, second sliding rod; 321, second pressing portion; 322, second hook portion; 330, blocking member; 331, first through hole; 332, second through hole; 333, third through hole; 340, resilient member; 350, first elastic member; 360, second elastic member; 370, rotating member; 380, pressing spring; 390, adapter.

DETAILED DESCRIPTION OF THE EMBODIMENTS

In order to make the above objects, features and advantages of the present disclosure more clearly understood, the specific embodiments of the present disclosure will be described in detail below with reference to the accompanying drawings. In the following description, numerous specific details are set forth in order to provide a thorough understanding of the present disclosure. However, the present disclosure can be implemented in many other ways different from those described herein, and those skilled in the art can make similar improvements without departing from the connotation of the present disclosure. Therefore, the present disclosure is not limited by the specific embodiments disclosed below.

As shown in FIGS. 1 to 9, an embodiment discloses a cooking device, including a box body 100, a door body 200, and a switch assembly 300. The box body 100 is provided with a buckle 110. The door body 200 is rotatably connected to the box body 100. The door body 200 is provided with a door hook 210 that is snap-fitted with the buckle 110. The door hook 210 is movable relative to the door body 200, and has a first position and a second position. When the door hook 210 is snap-fitted with the buckle 110, the door hook 210 is in the first position. When the door hook 210 is moved from the first position to the second position, the door hook 210 is separated from the buckle 110. The switch assembly 300 is arranged on the box body 100. The switch assembly 300 includes a first button 310, a second button 320, and a blocking member 330. The blocking member 330 can be moved relative to the first button 310 and/or the second button 320 and has a blocking position and an avoiding position. The first button 310 is used to drive the blocking member 330 to move from the blocking position to the avoiding position. The second button 320 has an initial position and an opening position. When the blocking member 330 is in the avoiding position, the second button 320 can be moved from the initial position to the opening position. The second button 320 can exert force on the door hook 210 and drives the door hook 210 to move from the first position to the second position. When the blocking member 330 is in the blocking position, the blocking member 330 is used to prevent the second button 320 from moving from the initial position to the opening position.

In the above cooking device, the door body 200 can be rotated relative to the box body 100 while approaching the box body 100, and the box body 100 is in a closed state through the snap-fit of the door hook 210 and the buckle 110. In this case, the door hook 210 is in the first position relative to the door body 200. When the cooking device needs to be opened, the first button 310 is used to drive the blocking member 330 to move from the blocking position to the avoiding position. In this case, the blocking member 330 will not block the movement of the second button 320, and the second button 320 can be moved from the initial position to the opening position relative to the box body 100. The second button 320 can contact the door hook 210 during the moving process, and drive the door hook 210 to move from the first position to the second position. When being in the second position, the door hook 210 is separated from the buckle 110, and in this case, the door body 200 can be separated from the box body 100. However, if only the second button 320 is operated, the second button 320 cannot be moved from the initial position to the opening position because the blocking member 330 is still in the blocking position. Therefore, the door hook 210 cannot be driven to move to the second position. If only the first button 310 is operated, the door hook 210 cannot be driven to move. Therefore, when the above cooking device needs to be opened, the first button 310 needs to be operated such that the blocking member 330 is driven to move, and then the second button 320 is operated such that the door hook 210 can be driven to move, which requires two-step operations to cooperate to open the cooking device, so that children can be prevented from accidentally opening the cooking device and the safety in use can be improved.

Optionally, the cooking device is a microwave oven, or a steamer, or a barbecue, or a micro-baking machine, or a steaming and baking machine, or a micro steaming and baking machine, etc.

Optionally, the movement of the door hook 210 relative to the door body 200 may be translation or rotation, so as to realize the movement from the first position to the second position.

Optionally, the first button 310 and the second button 320 may be operated by rotating, pressing, or sliding. That is, the first button 310 and the second button 320 are displaced by rotating, pressing, or sliding.

Optionally, the first button 310 drives the blocking member 330 to move relative to the box body 100, for example, by rotating or sliding, so that the blocking member 330 can be moved from the blocking position to the avoiding position by sliding or rotating relative to the box body 100.

In an embodiment, as shown in FIGS. 6 to 9, the box body 100 includes a control box 101. The blocking member 330 is provided with a first through hole 331 through which the first button 310 passes, and a second through hole 332 through which the second button 320 passes. A first pressing portion 311 is arranged on a side of the first button 310. When the first button 310 passes through the first through hole 331, the first pressing portion 311 contacts a hole wall of the first through hole 331, and exerts force on the blocking member 330, so that the blocking member 330 is moved from the blocking position to the avoiding position. When the blocking member 330 is in the avoiding position, the second button 320 can pass through the second through hole 332, and exert force on the door hook 210, so that the door hook 210 is moved from the first position to the second position. When the blocking member 330 is in the blocking position, the blocking member 330 is used to prevent the second button 320 from passing through the second through hole 332. When the first button 310 is moved so that the first button 310 passes through the first through hole 331 on the blocking member 330, the first pressing portion 311 on the side of the first button 310 can press the hole wall of the first through hole 331, so that the blocking member 330 is moved from the blocking position to the avoiding position. In this case, the second button 320 can be aligned with the second through hole 332, and pass through the second through hole 332, then the second button 320 can exert force on the door hook 210, so that the door hook 210 can be moved from the first position to the second position, and thus the door hook 210 is separated from the buckle 110. In this case, the box body 100 can be opened. However, if the first button 310 is not moved, the blocking member 330 is still in the blocking position, and the second button 320 is not aligned with the second through hole 332, and thus cannot pass through the second through hole 332, so that the second button 320 cannot exert force on the door hook 210 to separate the door hook 210 from the buckle 110. Therefore, it is necessary to press the first button 310 and the second button 320 to separate the door body 200 from the box body 100. In this way, it can prevent the operation of opening the cooking device accidentally, and the safety is better. In addition, the second through hole 332 can limit the movement of the second button 320 to ensure that the second button 320 can move in a predetermined manner.

As shown in FIGS. 6 to 9, a surface of the first pressing portion 311 configured to contact the hole wall of the first through hole 331 is a first contact surface 311*a*. The first contact surface 311*a* may be an inclined surface or an arc surface. A distance between the first contact surface 311*a* and the first button 310 gradually decreases in a direction of approaching the blocking member 330. As the first button 310 extends into the first through hole 331, the first contact surface 311*a* of the first pressing portion 311 continuously pushes the blocking member 330 in a certain direction, so that the second through hole 332 is moved from a position where the second through hole 332 is misaligned with the second button 320 to a position where the second through hole 332 is aligned with the second button 320. That is, the blocking member 330 is moved from the blocking position to the avoiding position. In this case, the second button 320 can pass through the second through hole 332 and exert force on the door hook 210.

Optionally, the blocking member 330 can be a long strip-shaped plate member or a circular plate member. When the blocking member 330 is a long strip-shaped plate member, the first through hole 331 and the second through hole 332 are arranged in sequence in a length direction of the blocking member 330. The blocking member 330 slidably cooperates with the box body 100. The blocking member 330 is translated relative to the box body 100 by pressing the blocking member 330 though the first button 310. When the blocking member 330 is a circular plate member, a center point of the blocking member 330 is spaced apart from the first through hole 331 and the second through hole 332 of the box body 100 along the circumferential direction of the blocking member 330. When the first button 310 presses the blocking member 330, the blocking member 330 is rotated relative to the box body 100.

Optionally, the first through hole 331 and the second through hole 332 are arranged at an interval, which facilitates the arrangement of the first button 310 and the second button 320 without positional interference. In addition, only the first through hole 331 may be provided, and the blocking member 330 may be pressed by the first button 310, so that the blocking member 330 is moved from the blocking position where the blocking member 330 blocks the second button 320 to the position where the blocking member 330 does not block the second button 320. In this case, when the second button 320 is pressed, there is no positional interference between the blocking member and the second button 320, so that the second button 320 can exert force on the door hook 210. Or, the first through hole 331 and the second through hole 332 are not provided, an edge of the blocking member 330 may be pressed by the first pressing portion 311 of the first button 310, so that the blocking member 330 is moved from the blocking position to the avoiding position.

Optionally, both the first button 310 and the second button 320 are pressed to move relative to the box body 100. The first button 310 is firstly pressed to move the blocking member 330 to the avoiding position, and then the second button 320 is pressed to pass through the second through hole 332 and exerts force on the door hook 210. However, in other embodiments, the first button 310 can also drive the blocking member 330 to move by sliding or rotating relative to the box body 100. For example, the first button 310 is connected to the blocking member 330, and the first button 310 slidably cooperates with the box body 100. When the first button 310 slides relative to the box body 100, the blocking member 330 also slides relative to the box body 100 synchronously and moves from the blocking position to the avoiding position. Or, the first button 310 is rotatably connected to the box body 100, the blocking member 330 is connected to the first button 310. When the first button 310 is not rotated, the blocking member 330 is in the blocking position. When the first button 310 is rotated, the blocking member 330 is rotated to the avoiding position synchronously, so that the blocking member 330 will not block the movement of the second button 320. Or, the first button 310 is rotatably connected to an end of the blocking member 330, the middle of the blocking member 330 is rotatably connected to the box body 100. The other end of the blocking member 330 is used to block the second button 320. The first button 310 slidably cooperates with the box body 100. In this case, by operating the first button 310 to slide relative to the box body 100, the blocking member 330 can be driven to rotate away from the end of the first button 310, and to move from the blocking position to the avoiding position.

Figure 8:
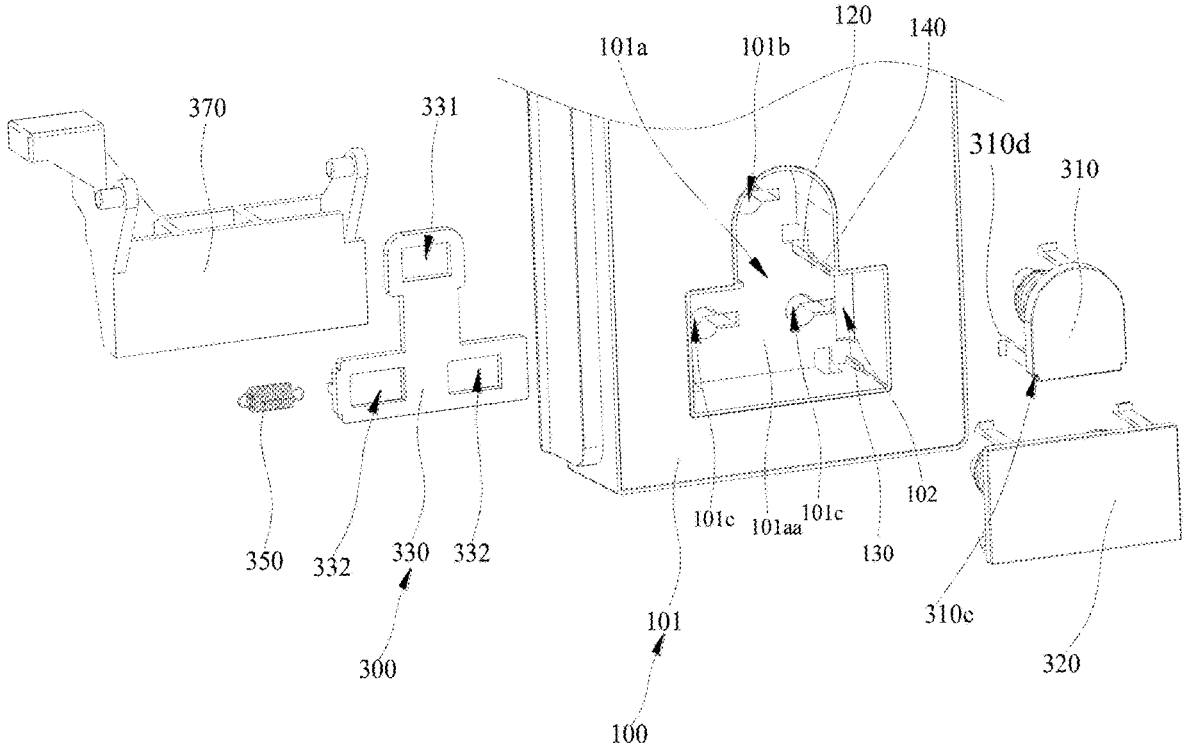
FIG. 8 is a first schematic view of a box body and a switch assembly that are assemble together according to an embodiment of the present disclosure.
Figure 9:
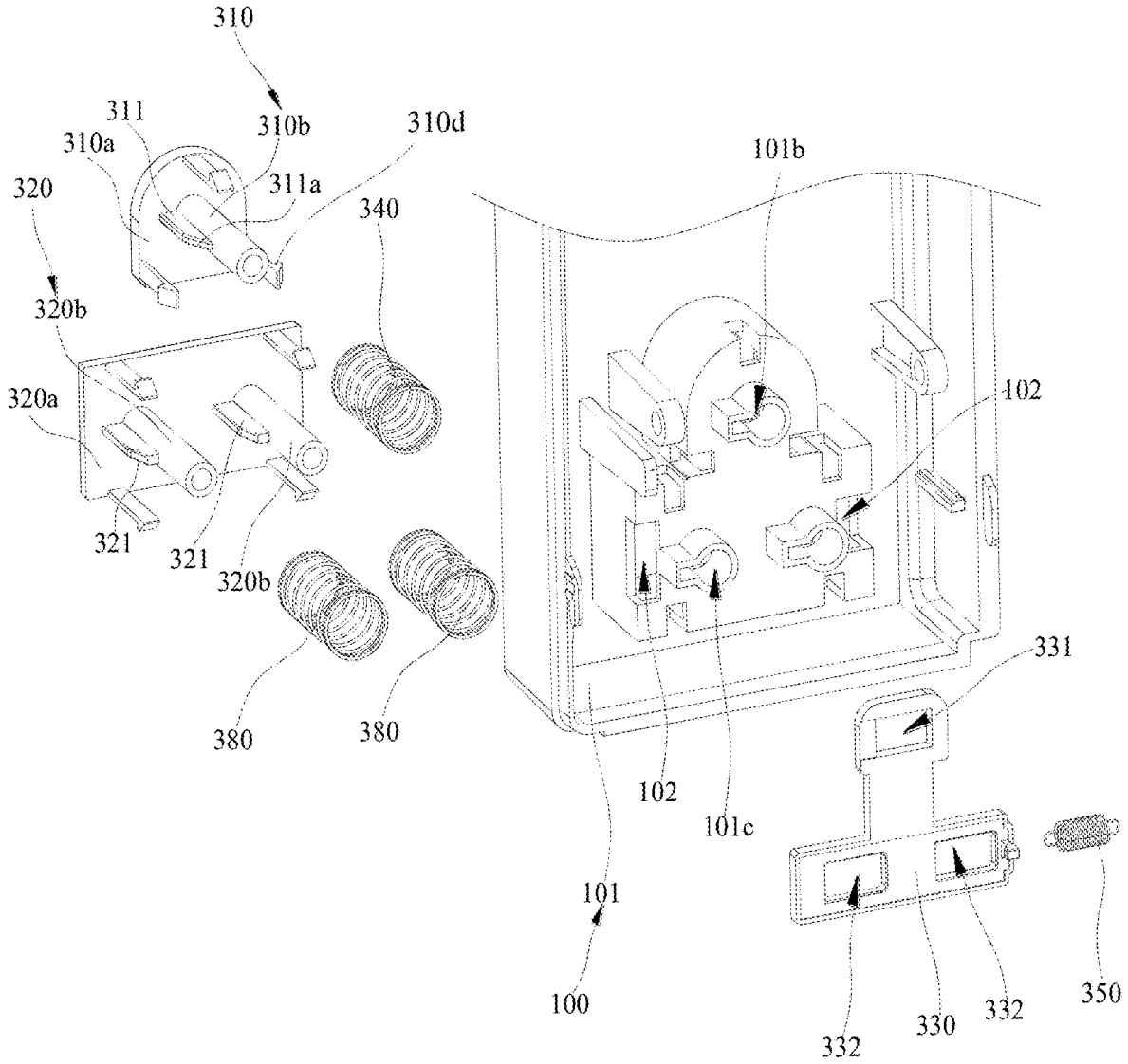
FIG. 9 is a second schematic view of a box body and a switch assembly that are assemble together according to an embodiment of the present disclosure, from another perspective.

In an embodiment, as shown in FIGS. 8 and 9, the control box 101 is provided with a button groove 101*a*. The first button 310 includes a first pressing plate 310*a* and a first sliding rod 310*b*. The second button 320 includes a second pressing plate 320*a* and a second sliding rod 320*b*. The first pressing plate 310*a* and the second pressing plate 320*a* are both arranged in the button groove 101*a*, and can slide in the depth direction of the button groove 101*a*. The second sliding rod 320*b* can extend through a rear wall 101*aa* of the button groove 101*a*, and extend into the box body 100. The blocking member 330 is arranged on a wall of the button groove 101*a*. By pressing the first button 310 and the second button 320, the first button 310 and the second button 320 can be moved in the depth direction of the button groove 101*a*.

In an embodiment, as shown in FIGS. 8 and 9, the first pressing portion 311 is arranged on a side of the first sliding rod 310*b*, and a second pressing portion 321 is arranged on a side of the second sliding rod 320*b*. When the blocking member 330 is in the blocking position, the second pressing portion 321 cannot pass through the second through hole 332. When the blocking member 330 is in the avoiding position, the second sliding rod 320*b* and the second pressing portion 321 can pass through the second through hole 332, and the second sliding rod 320*b* can exert force on the door hook 210 and drives the door hook 210 to move from the first position to the second position. When the first button 310 exerts force on the blocking member 330 to move the blocking member 330 to the avoiding position, the second sliding rod 320*b* and the second pressing portion 321 can pass through the second through hole 332. In this case, the second button 320 can be displaced, and exert force on the door hook 210 to move the door hook 210 from the first position to the second position. By arranging the second pressing portion 321, the second button 320 can be prevented from moving along the second through hole 332 and directly exerting force on the blocking member 330 when the blocking member 330 is not moved to the avoiding position, which can better prevent the cooking device from being accidentally opened. In addition, a second end of the second button 320 extends through the second through hole 332 regardless of whether the blocking member 330 is in the blocking position or the avoiding position, which reduces the moving stroke required by the second button 320 to exert force on the door hook 210, which is convenient for use.

Figure 6:
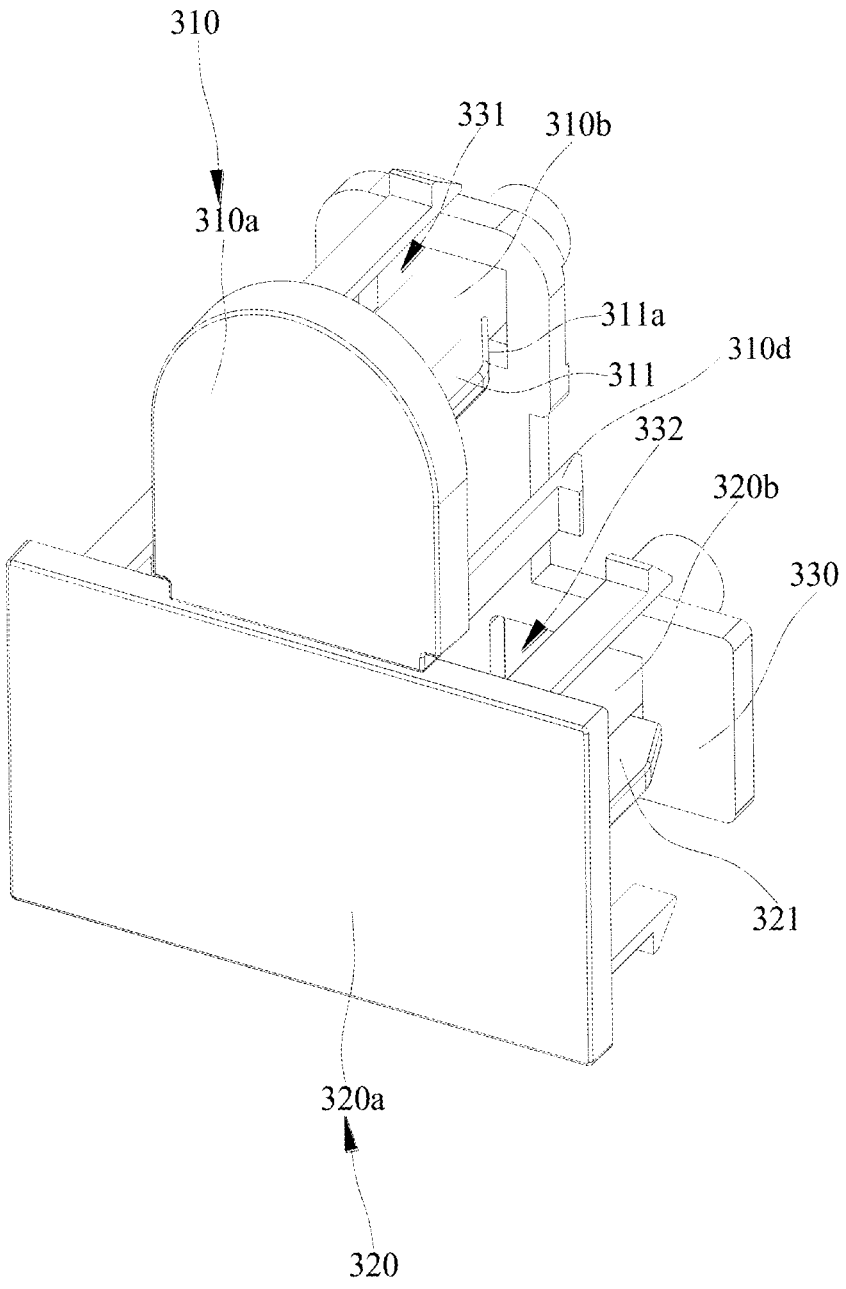
FIG. 6 is a first schematic view of a blocking member in a blocking position and a second button in an initial position according to an embodiment of the present disclosure.
Figure 7:
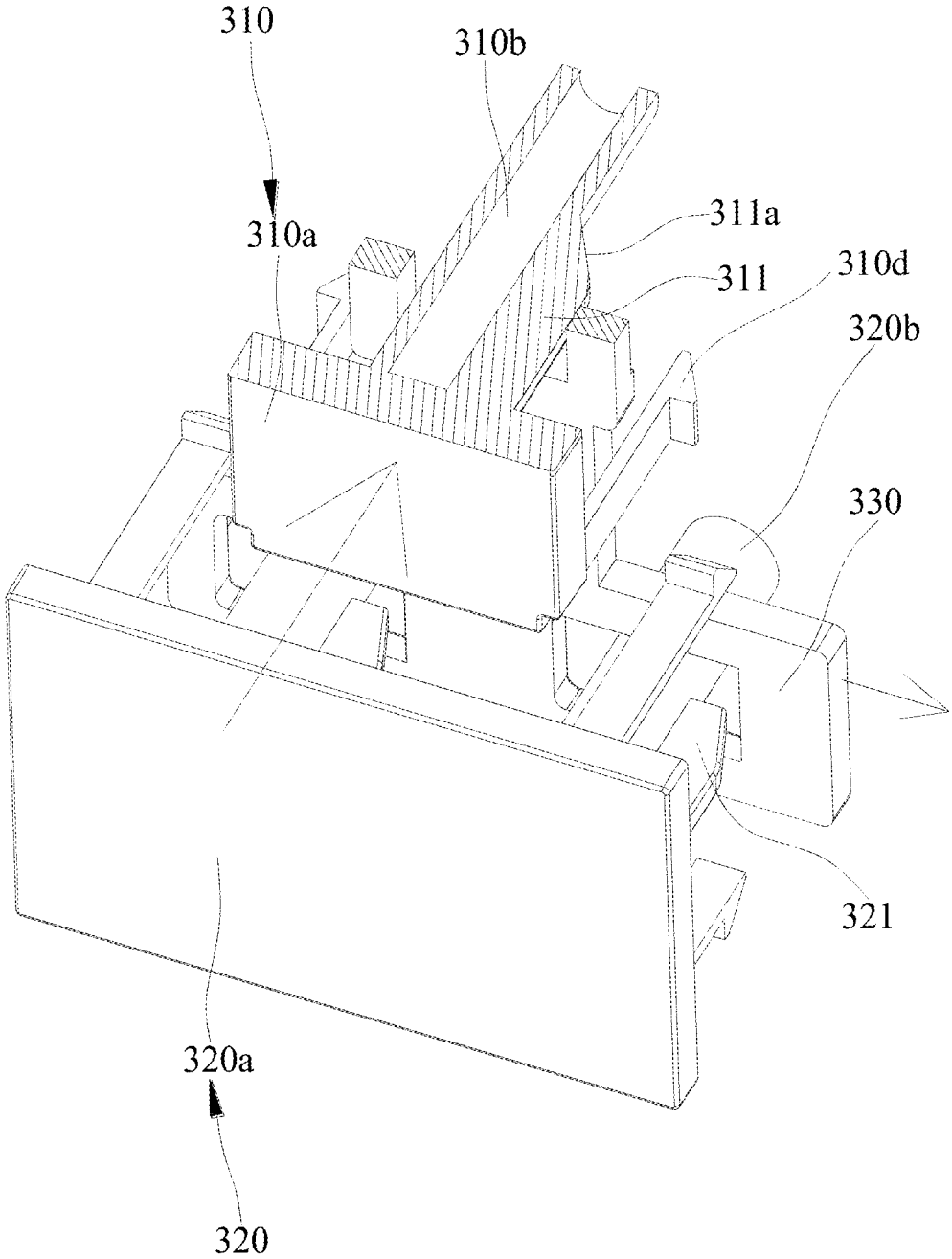
FIG. 7 is a first schematic view of a blocking member in an avoiding position and a second button in an initial position according to an embodiment of the present disclosure.

Optionally, as shown in FIG. 6, the second button 320 includes a first end and the second end. The second pressing portion 321 is arranged on a side of the first end. When the blocking member 330 is in the blocking position, the second end extends through the second through hole 332, and the second pressing portion 321 is in contact with a side surface of the blocking member 330, or is arranged opposite to the side surface of the blocking member 330. When the blocking member 330 is in the avoiding position, the first end and the second pressing portion 321 can pass through the second through hole 332, and drive the door hook 210 to move from the first position to the second position. A portion of the second end passing through the second through hole 332, and the second pressing portion 321 are located on both sides of the blocking member 330, respectively. When the blocking member 330 is in the blocking position, the portion of the second end passing through the second through hole 332 can be, for example, in indirect contact with the door hook 210, then when the blocking member 330 is moved to the avoiding position, the movement of the second button 320 can exerts force on the door hook 210, and thus the moving stroke of the second button 320 is shorter. In an optional embodiment, the second button 320 and the door hook 210 can be in direct contact or in indirect contact, so that the second button 320 can drive the door hook 210 to move from the first position to the second position.

Optionally, there are at least two second sliding rods 320*b* and at least two second through holes 332, and the first pressing plate 310*a* and the second pressing plate 320*a* are arranged in a T-shape. In this case, the first pressing plate 310*a* is pressed firstly, and then the second pressing plate 320*a* is pressed, which is easy to operate, and because there are at least two second sliding rods 320*b*, the displacement of the second pressing plate 320*a* is more stable when being pressed.

Optionally, a length of the second pressing plate 320*a* is greater than a length of the first pressing plate 310*a*, so the connection between the first pressing plate 310*a* and the second pressing plate 320*a* is located in the middle section of the second pressing plate 320*a* to form a T-shaped structure.

Figure 4:
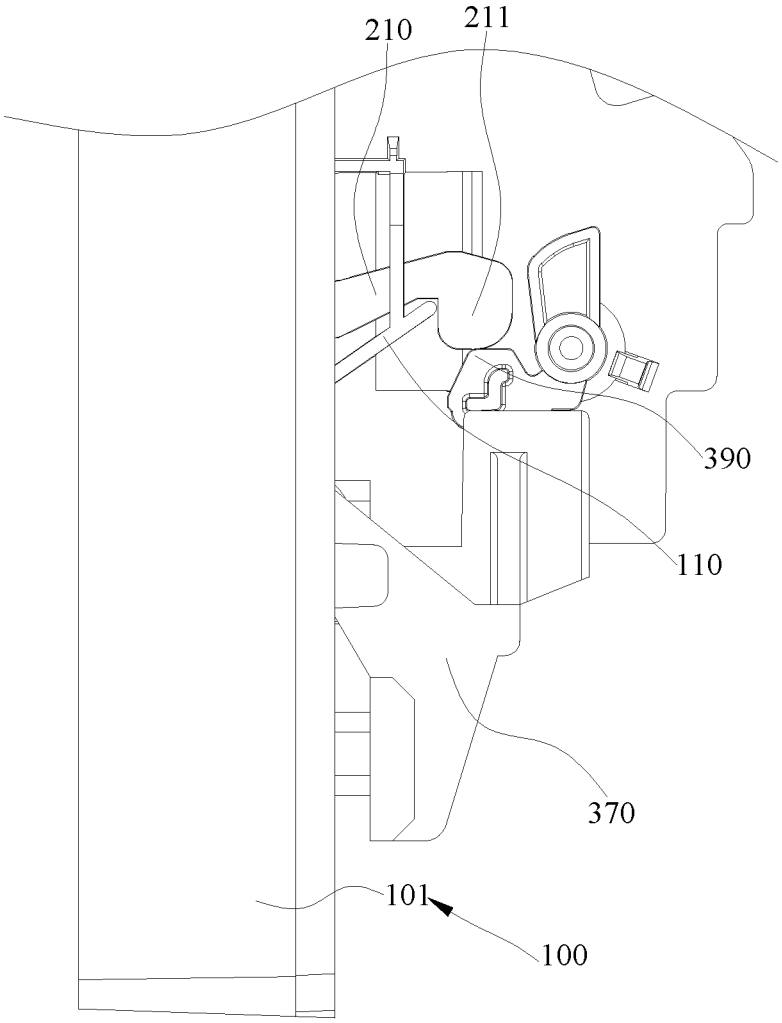
FIG. 4 is a schematic view of a door hook in a first position according to an embodiment of the present disclosure.
Figure 5:
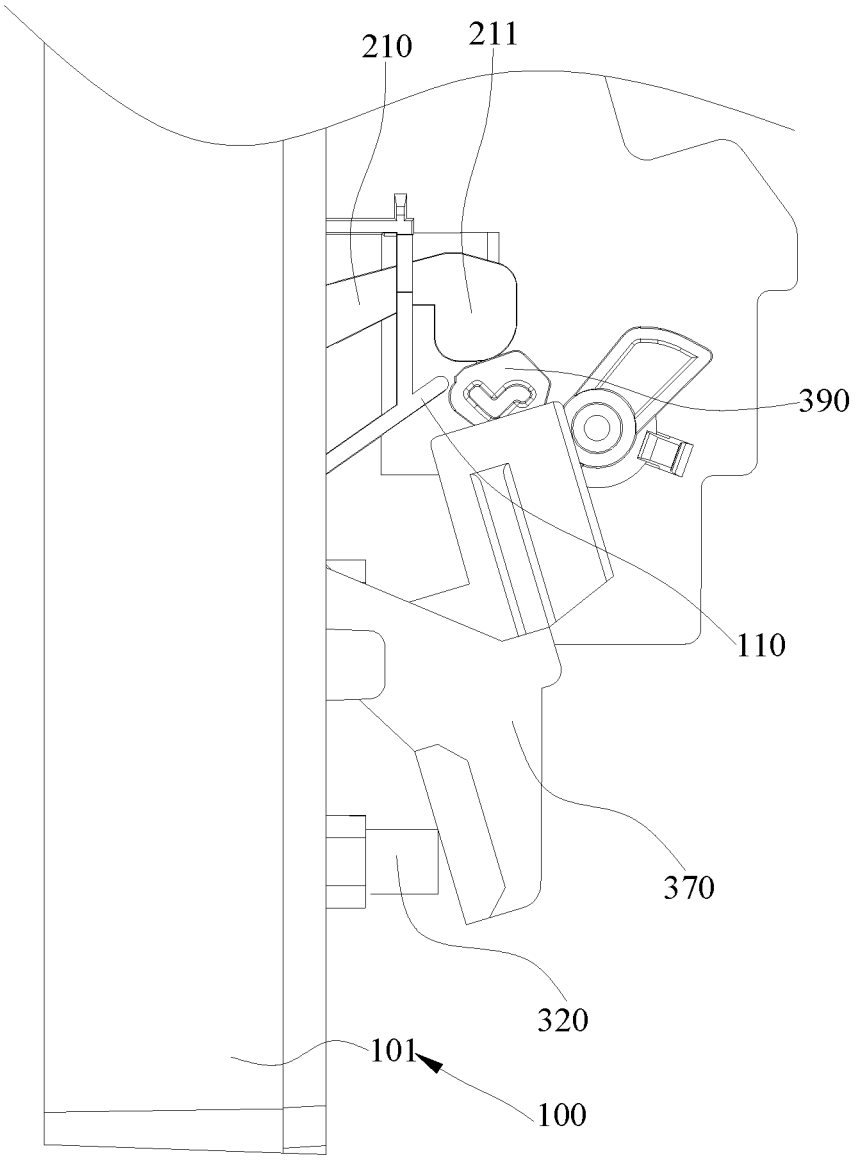
FIG. 5 is a schematic view of a second button in an opening position and a door hook in a second position according to an embodiment of the present disclosure.

In an embodiment, as shown in FIGS. 4, 5, and 9, the control box 101 is further provided with a rotating member 370, and a first stroke hole 101*b* and a second stroke hole 101*c* are arranged on the rear wall of the button groove 101*a*. The first stroke hole 101*b* and the second stroke hole 101*c* are used in cooperation with the first sliding rod 310*b* and the second sliding rod 320*b*, respectively. The second sliding rod 320*b* extends out of the second stroke hole 101*c* and pushes the rotating member 370 at a position of the maximum stroke, so that the rotating member 370 directly or indirectly exerts force on the door hook 210, and drives the door hook 210 to move from the first position to the second position. Only when the second sliding rod 320*b* can extend out of the second stroke hole 101*c*, can the rotating member 370 be pushed, and the door hook 210 can be directly or indirectly driven to detach from the buckle 110, which further improves the safety performance.

In an embodiment, a first limiting portion 120 and a second limiting portion 130 are arranged on a sidewall of the button groove 101*a*. The first limiting portion 120 is used to limit the stroke of the first pressing plate 310*a*, and the second limiting portion 130 is used to limit the stroke of the second pressing plate 320*a*. The first limiting portion 120 and the second limiting portion 130 can limit the moving stroke of the first button 310 and the second button 320, which is more convenient to use.

Optionally, when the blocking member 330 is in the blocking position, a distance between the first limiting portion 120 and the first pressing plate 310*a* is less than a distance between the second limiting portion 130 and the second pressing plate 320*a*. Since the distance between the first limiting portion 120 and the first pressing plate 310*a* is less than the distance between the second limiting portion 130 and the second pressing plate 320*a*, the moving stroke of the first button 310 is shorter, which can prevent the cooking device from being opened accidentally due to the force exerted by the first button 310 on the door hook 210 caused by the too long moving distance of the first button 310.

In an embodiment, an abutting portion 310*d* is arranged on a side of the first pressing plate 301*a* close to the first sliding rod 310*b*. The abutting portion 310*d* is used for contacting a bottom surface of the button groove 101*a* or the blocking member 330. In this case, after the first button 310 moves a certain distance, the abutting portion 310*d* contacts the bottom surface of the button groove 101*a*, so that the first button 310 cannot continue to move, or the moving stroke of the first button 310 can be limited, preventing the cooking device from being opened accidentally due to the force exerted by the first button 310 on the door hook 210 caused by the tool long moving distance of the first button 310.

Optionally, the abutting portion 310*d* is a columnar structure capable of contacting the bottom surface of the button groove 101*a* or the blocking member 330.

Optionally, a length of the first sliding rod 310*b* is less than a length of the second sliding rod 320*b*. The second sliding rod 320*b* needs to exert force on the door hook 210, so the length of the second sliding rod 320*b* is longer, and the length of the first sliding rod 310*b* is shorter, which can prevent the first sliding rod 310*b* from exerting force on the door hook 210, and has a better effect of preventing the cooking device from being opened accidentally.

In an embodiment, as shown in FIGS. 8 and 9, guide holes 102 are arranged on two opposite sidewalls of the button groove 101*a*. Two ends of the blocking member 330 extend through two guide holes 102, respectively. The second limiting portion 130 is arranged on a side of the blocking member 330 away from the bottom surface of the button groove 101*a*. The guide holes 102 can limit the movement of the blocking member 330, so that the blocking member 330 is moved more stably. In addition, the blocking member 330 passing through the wall of the button groove 101*a* can make the structure more compact and the occupied space reduced. Moreover, the pressing of the second button 320 will not cause the second button 320 contacts the blocking member 330, which can prevent the second button 320 from affecting the movement of the blocking member 330.

In an embodiment, a rotating shaft is arranged at a side of the rear wall of the button groove 101*a* close to the box body 100. The blocking member 330 is rotatably arranged on the rotating shaft. In this case, the blocking member 330 can be switched between the blocking position and the avoiding position by rotating.

In an embodiment, as shown in FIGS. 8 and 9, the switch assembly 300 further includes a first elastic member 350. Two ends of the first elastic member 350 are respectively connected to the blocking member 330 and the control box 101. The first elastic member 350 is used to move the blocking member 330 from the avoiding position to the blocking position. The blocking member 330 slidably cooperates with the control box 101. The blocking member 330 can reciprocate and translate relative to the control box 101 between the blocking position and the avoiding position.

In an embodiment, the switch assembly 300 further includes a first elastic member 350. Two ends of the first elastic member 350 are respectively connected to the blocking member 330 and the control box 101. The first elastic member 350 is used to move the blocking member 330 from the avoiding position to the blocking position. The blocking member 330 rotatably cooperates with the control box 101. The blocking member 330 can reciprocate and rotate relative to the control box 101 between the blocking position and the avoiding position. When the first pressing portion 311 of the first button 310 presses the blocking member 330 to move the blocking member 330 from the blocking position to the avoiding position, the first elastic member 350 and a resilient member 340 are both in a compressed state. When the first button 310 and the second button 320 are returned, the first elastic member 350 can drive the blocking member 330 to return to the blocking position, which is convenient for re-operation.

When the blocking member 330 rotatably cooperates with the control box 101, one of the control box 101 and the blocking member 330 is provided with the above-mentioned rotating shaft, and the other of the control box 101 and the blocking member 330 is provided with a shaft hole. The rotating shaft extends through the shaft hole and rotatably cooperates with the shaft hole. The first elastic member 350 is a torsion spring and is sleeved outside the rotating shaft. Optionally, the blocking member 330 is provided with a rotation guide hole. The rotation guide hole extends along a rotating direction of the blocking member 330 relative to the control box 101. A guide post is arranged on the control box 101. The guide post extends through and slidably cooperates with the rotation guide hole. When the blocking member 330 rotates relative to the control box 101, the guide post slides along the rotation guide hole, which can ensure the smooth rotation of the blocking member 330. Optionally, the control box 101 is provided with a clamping member. The clamping member includes a first subsection and a second subsection. The first subsection is connected to the second subsection. The first subsection is connected to the control box 101. The second subsection is bent toward a side of the second subsection, and is spaced apart from the control box 101. An outer edge of the blocking member 330 is located in a gap between the second subsection and the control box 101. In this case, the clamping member can prevent the blocking member 330 from detaching from the control box 101 in a direction away from the control box 101, thereby ensuring the stability of the structure. Specifically, there are at least two clamping members, and the clamping members are arranged at intervals along the circumferential direction of the blocking member 330 to limit the different portions of the blocking member 330 respectively, which can better prevent the blocking member 330 from detaching from the control box 101.

In an embodiment, as shown in FIGS. 8 and 9, a first sliding portion is arranged on the sidewall of the button groove 101*a*, and a second sliding portion is arranged on the first pressing plate 310*a*. One of the first sliding portion and the second sliding portion is a first guide rail 140, and the other of the first sliding portion and the second sliding portion is a first guide groove 310*c* that slidably cooperates with the first guide rail 140; and/or a third sliding portion is arranged on the sidewall of the button groove 101*a*, and a fourth sliding portion is arranged on the second pressing plate 310*b*. One of the third sliding portion and the fourth sliding portion is a second guide rail, and the other of the third sliding portion and the fourth sliding portion is a second guide groove that slidably cooperates with the second guide rail. Through the cooperation of the guide rail and the guide groove, the first button 310 and the second button 320 can be moved more stably, and can exert the force in a more precise direction.

Figure 10:
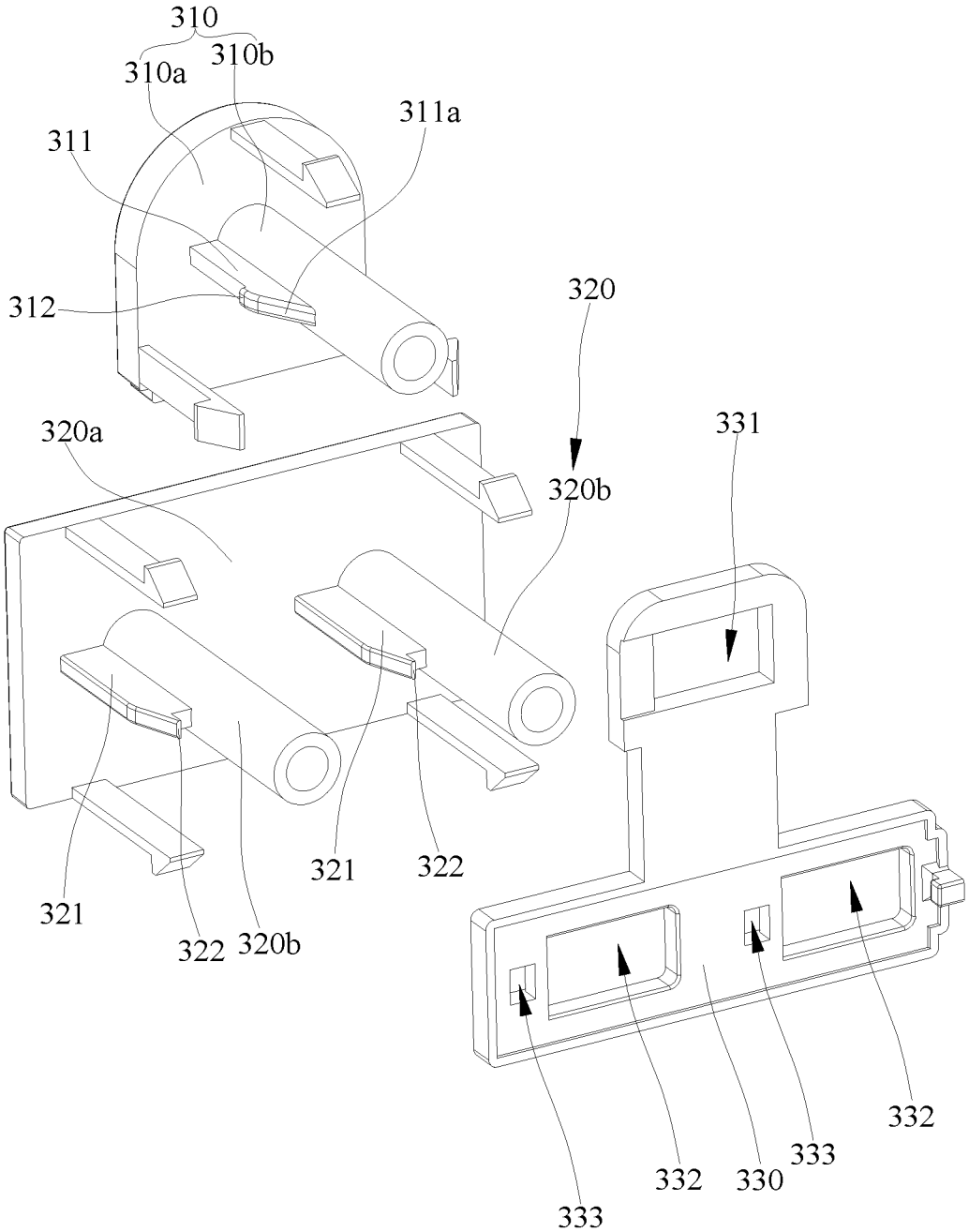
FIG. 10 is a schematic view of a first button, a second button, and a blocking member that are assemble together according to an embodiment of the present disclosure.
Figure 11:
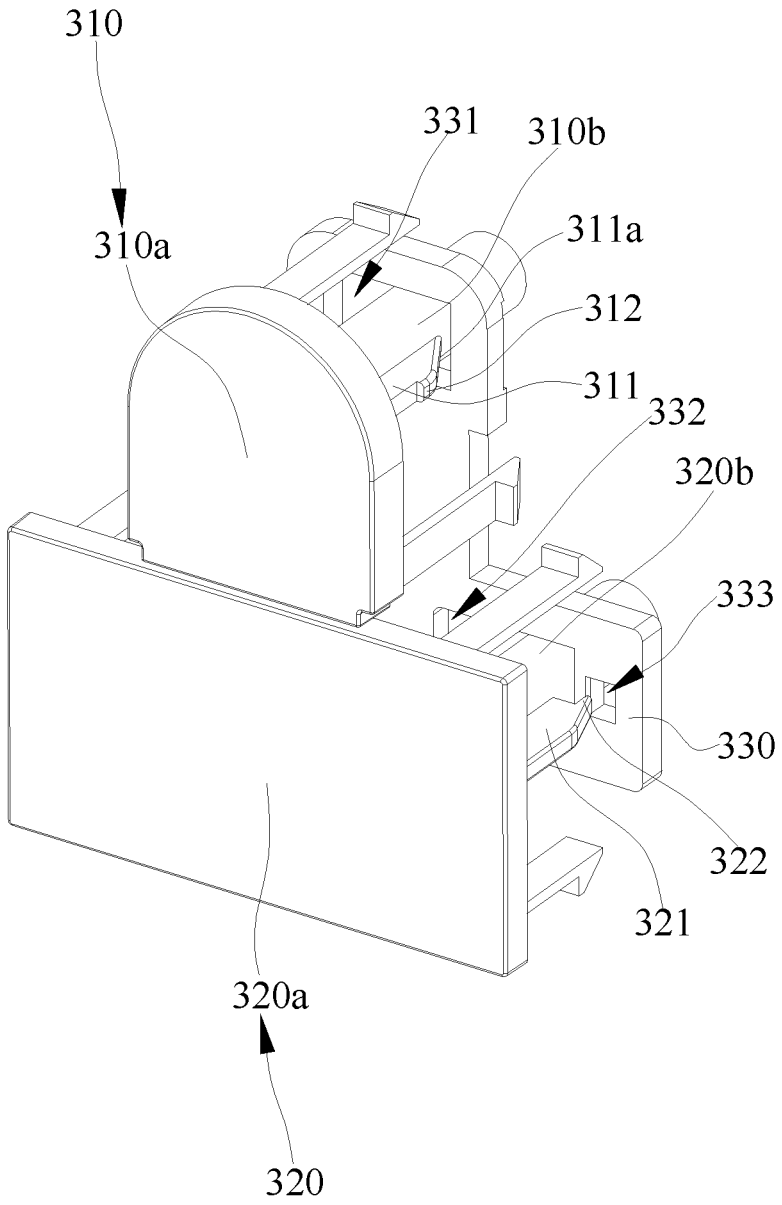
FIG. 11 is a second schematic view of a blocking member in a blocking position and a second button in an initial position according to an embodiment of the present disclosure.
Figure 12:
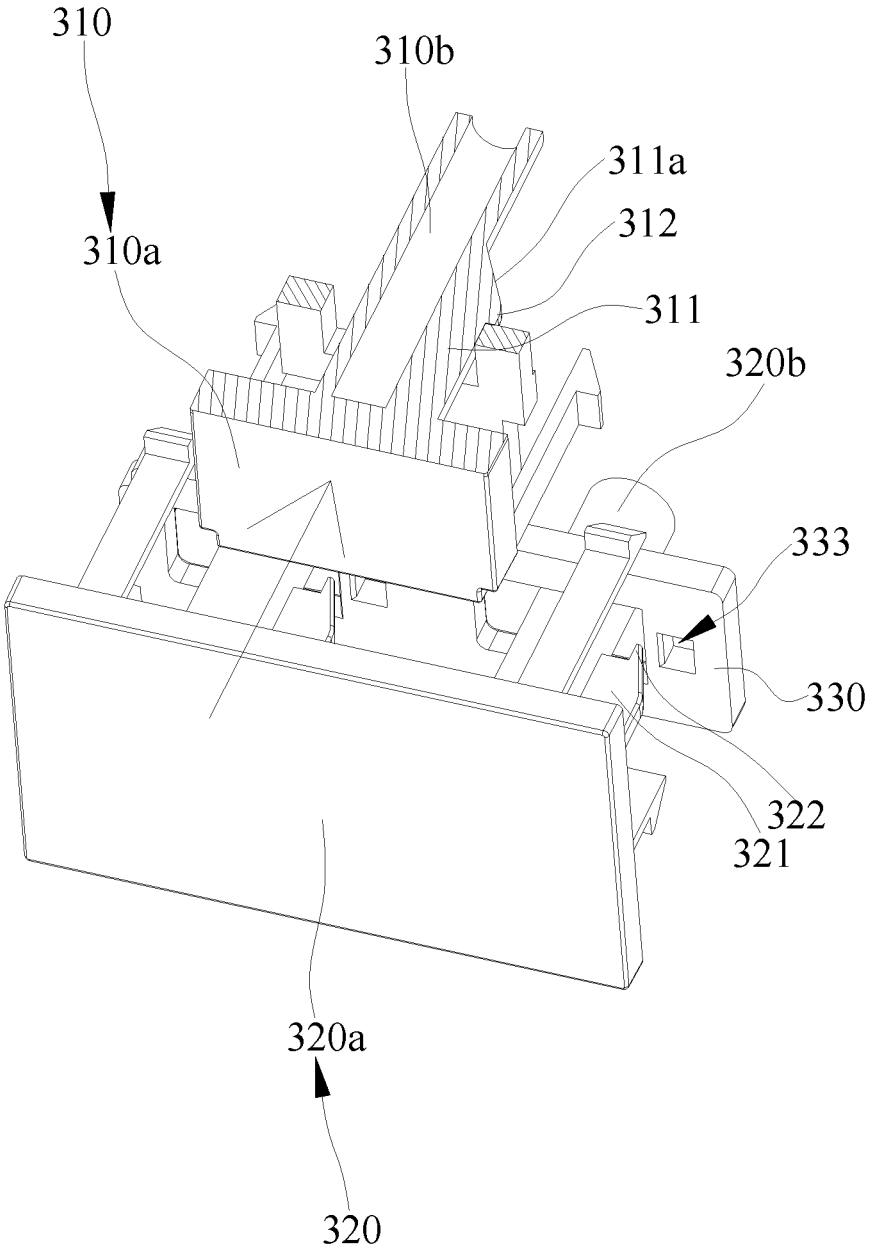
FIG. 12 is a second schematic view of a blocking member in an avoiding position and a second button in an opening position according to an embodiment of the present disclosure.

In an embodiment, as shown in FIGS. 10 to 12, a third through hole 33 is arranged on the blocking member 330. A second hook portion 322 is arranged on a side of the second button 320 close to the third through hole 333. When the second button 320 is in the initial position, the second hook portion 322 is spaced apart from the blocking member 330, and the second hook portion 322 is opposite to the third through hole 333. When the blocking member 330 is moved to the avoiding position, the second hook portion 322 is arranged opposite to the second through hole 332. When the second button 320 is pressed alone or the first button 310 and the second button 320 are pressed simultaneously, the second hook portion 322 on the second button 320 will be inserted into the third through hole 333, and the second button 320 and the blocking member 330 cannot continue to move, preventing the box body 100 from being opened by one-step operation. After the above configuration, the first button 310 can only be pressed first, so that the blocking member 330 is moved from the blocking position to the avoiding position. At this case, the second through hole 332 is arranged opposite to the second hook portion 322, and the second button 320 can pass through the second through hole 332, the blocking member 330 does not blocks the second button 320. The door hook 210 can be moved from the first position to the second position by pressing the second button 320 to exert force on the door hook 210, that is, the box body 100 is opened through two-step operations, which is more secure.

In an embodiment, as shown in FIGS. 10 to 12, the switch assembly 300 further includes the resilient member 340. Two ends of the resilient member 340 abut against the first button 310 and the control box 101 respectively. A first hook portion 312 is arranged on the first pressing portion 311 of the first button 310. When the first button 310 passes through the first through hole 331, the resilient member 340 is pressed. After passing through the first through hole 331, the first hook portion 312 abuts against the side surface of the blocking member 330 under the restoring force of the resilient member 340, to stop the first button 310. The second pressing portion 321 is arranged on a side of the second button 320. When the second button 320 is moved from the initial position to the opening position, and passes through the second through hole 332, the second pressing portion 321 presses the hole wall of the second through hole 332, so that the blocking member 330 is moved in the direction from the blocking position to the avoiding position. When the first through hole 331 is moved to a position opposite to the first hook portion 312, the blocking member 330 releases the stopping effect on the first button 310. When the first pressing portion 311 of the first button 310 presses the blocking member 330 to move the blocking member 330 from the blocking position to the avoiding position, the first elastic member 350 and the resilient member 340 are both in a compressed state. When the first button 310 passes through the first through hole 331, the first hook portion 312 is moved from one side of the blocking member 330 to the other side of the blocking member 330. At the same time, the first hook portion 312 abuts against the side surface of the blocking member 330. In this case, the resilient member 340 will drive the first button 310 to be returned, so that the first hook portion 312 is tightly hooked to the blocking member 330. In addition, under the action of the first elastic member 350, the blocking member 330 will also be returned, and abut against the first button 310, so that the first button 310 cannot be returned. In this way, during operation, the user can release the first button 310 and then operate the second button 320, which is more convenient to use. When the second button 320 is operated, the second button 320 presses the hole wall of the second through hole 332 when passing through the second through hole 332, so that the second through hole 332 is moved in the direction from the blocking position to the avoiding position. In this case, the displacement of the blocking member 330 enables the first hook portion 312 to pass through the first through hole 331 again, and the first button 310 can be returned under the action of the resilient member 340 to facilitate subsequent operations.

Optionally, the surface of the second pressing portion 321 contacting the hole wall of the second through hole 332 is a second contact surface. The second contact surface can be an inclined surface or an arc surface. A distance between the second contact surface and the second button 320 gradually decreases in a direction of approaching the blocking member 330. The maximum displacement of the blocking member 330 when the second pressing portion 321 presses the blocking member 330 is less than the maximum displacement of the blocking member 330 when the first pressing portion 311 presses the blocking member 330. The second pressing portion 321 presses the blocking member 330 so that the first hook portion 312 can pass through the first through hole 331, and in this case, the displacement required is smaller. Specifically, the second pressing portion 321 is arranged on the second sliding rod 320*b*, the minimum distance between the second contact surface and the second sliding rod 320*b* is greater than 0, and the end of the second pressing portion 321 close to the blocking member 330 is not the tip. In this case, if the second button 320 is operated to move from the initial position to the opening position, the second pressing portion 321 will abut against the blocking member 330 so that the second button 320 cannot continue to move. When the blocking member 330 is moved to the avoiding position, the second pressing portion 321 can pass through the second through hole 332, and press the hole wall of the second through hole 332 by the second contact surface.

Optionally, the first hook portion 312 and the first pressing portion 311 are both arranged on the same side of the first sliding rod 310*b*, and the first hook portion 312 is connected to the first pressing portion 311, and the first hook portion 312 is arranged on the side of the first pressing portion 311 away from the first sliding rod 310*b*. Specifically, the first pressing portion 311 includes an inclined end and a flat end. The inclined end is arranged on the side of the flat end close to the blocking member 330. The first contact surface 311*a* is arranged on the inclined end. A distance from a side surface of the flat end away from the first sliding rod 310*b* to the first sliding rod 310*b* is the same. The first hook portion 312 is arranged at the connection between the inclined end and the flat end. In this way, the first hook portion 312 forms a protruding structure. After passing through the first through hole 331, the first hook portion 312 can abut against the side surface of the blocking member 330 to prevent the first button 310 from being returned.

Optionally, the third through hole 333 is arranged on the side of the second through hole 332 close to the first through hole 331. The first through hole 331, the second through hole 332, and the third through hole 333 are arranged at intervals.

Optionally, the second hook portion 322 is arranged on an end surface of the second pressing portion 321 close to the blocking member 330, and is spaced apart from the second sliding rod 320*b*. In this case, the second hook portion 322 can extend into the third through hole 333. In addition, the second hook portion 322 will not be stuck on the blocking member 330 after passing through the second through hole 332, and thus the second button 320 can be smoothly moved back and forth along the second through hole 332.

In an embodiment, as shown in FIGS. 1 to 9, the switch assembly 300 further includes a second elastic member 360. Two ends of the second elastic member 360 are connected to the door body 200 and the door hook 210, respectively. The second elastic member 360 is used to move the door hook 210 from the second position to the first position. When the second button 320 is moved from the initial position to the opening position, the second button 320 pushes the rotating member 370 to rotate. The rotating member 370 directly or indirectly pushes the door hook 210 to move from the first position to the second position. When the second button 320 is moved from the initial position to the opening position, the second button 320 can push the rotating member 370 to rotate. The rotation of the rotating member 370 can push the door hook 210 to move, so that the door hook 210 is moved from the first position to the second position. Through arranging the rotating member 370, the second button 320 can exert force on the door hook 210 indirectly, which can increase the design distance between the second button 320 and the door hook 210, so that the structure in the box body 100 is arranged more reasonably, and the moving stroke of the second button 320 can be reduced, which is convenient for operation.

Optionally, as shown in FIGS. 1 to 5, the buckle 110 is located in the box body 100. The door body 200 is provided with an insertion opening 103. An end of the door hook 210 away from the door body 200 is a hook-shaped portion 211. The door hook 210 is located in the first position under the action of the second elastic member 360. When the end of the door body 200 provided with the door hook 210 approaches the box body 100, the door hook 210 extends into the insertion opening 103. When the door hook 210 extends into the insertion opening 103 and contacts the buckle 110, the hook-shaped portion 211 is pressed by the buckle 110, so that the door hook 210 is moved from the first position to the second position. When the door hook 210 continues to extend into the insertion opening 103, the hook-shaped portion 211 will not be pressed by the buckle 110, and the second elastic member 360 is restored and drives the door hook 210 to move from the second position to the first position. In this case, the hook-shaped portion 211 will hook the buckle 110 to prevent the door body 200 from moving away from the box body 100.

Optionally, a pressing spring 380 is arranged between the second button 320 and the control box 101. The pressing spring 380 is arranged between the second pressing plate 320*a* and the control box 101. When the second button 320 is moved from the initial position to the opening position, the pressing spring 380 is pressed. At this time, if the second button 320 is released, the second button 320 can be returned under the action of the pressing spring 380.

Optionally, as shown in FIGS. 4 and 5, the switch assembly 300 further includes an adapter 390. A torsion spring is arranged at the connection between the adapter 390 and the box body 100. Two ends of the torsion spring are connected to the adapter 390 and the box body 100, respectively. Two parts of the adapter 390 are respectively used to contact the door hook 210 and the rotating member 370. When the second button 320 is moved from the initial position to the opening position, the second button 320 pushes the rotating member 370 to rotate. Then, the rotating member 370 pushes the adapter 390 to rotate, and the adapter 390 pushes the door hook 210 to move from the first position to the second position, so that the door hook 210 is separated from the buckle 110.

The technical features of the above-described embodiments can be combined arbitrarily. To simplify the description, not all possible combinations of the technical features in the above embodiments are described. However, all of the combinations of these technical features should be considered as being fallen within the scope of the present disclosure, as long as such combinations do not contradict with each other.

The foregoing embodiments merely illustrate some embodiments of the present disclosure, and descriptions thereof are relatively specific and detailed. However, it should not be understood as a limitation to the patent scope of the present disclosure. It should be noted that, a person of ordinary skill in the art may further make some variations and improvements without departing from the concept of the present disclosure, and the variations and improvements falls in the protection scope of the present disclosure. Therefore, the protection scope of the present disclosure shall be subject to the appended claims.

In the description of the present disclosure, it should be understood that orientation or positional conditions indicated by terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential" etc. are based on orientation or positional relationships shown in the drawings, which are merely to facilitate the description of the present disclosure and simplify the description, not to indicate or imply that the device or elements must have a particular orientation, be constructed and operated in a particular orientation, and therefore cannot be construed as a limitation on the present disclosure.

In addition, the terms "first" and "second" are used for description only, and cannot be understood as indicating or implying relative importance or implicitly indicating the number of technical features indicated. Thus, the features defined with "first" and "second" may include at least one of the features explicitly or implicitly. In the description of the present disclosure, the meaning of "plurality" is at least two, for example, two, three or the like, unless explicitly and specifically defined otherwise.

In the present disclosure, unless explicitly specified and defined otherwise, terms "mounting", "connecting", "connected", and "fixing" should be understood in a broad sense. For example, it may be a fixed connection or a detachable connection, or an integration; may be a mechanical connection or electrical connection; may be a direct connection, or may be a connection through an intermediate medium, may be the communication between two elements or the interaction between two elements, unless explicitly defined otherwise. The specific meanings of the above terms in the present disclosure can be understood by one of those ordinary skills in the art according to specific circumstances.

In the present disclosure, unless expressly specified and defined otherwise, a first feature being "on" or "below" a second feature may mean that the first feature is in direct contact with the second feature, or may mean that the first feature is in indirect contact with the second feature through an intermediate medium. Moreover, the first feature being "over", "above", and "at the top of" the second feature may mean that the first feature is directly above or obliquely above the second feature, or simply mean that the level of the first feature is higher than that of the second feature. The first feature being "below", "under" and "beneath" the second feature may mean that the first feature is directly below or obliquely below the second feature, or simply mean that the level of the first feature is smaller than that of the second feature.

It should be noted that when an element is referred to as being "fixed to" or "arranged on" another element, it can be directly on another element or there may be an intermediate element therebetween. When an element is considered to be "connected to" another element, it can be directly connected to another element or there may be an intermediate element therebetween at the same time. The terms "vertical", "horizontal", "upper", "lower", "left", "right", and the like used herein are for illustrative purposes only and are not intended to be the only embodiments.

What is claimed is:

1. A cooking device, comprising:

a box body provided with a buckle;

a door body rotatably connected to the box body, and wherein the door body is provided with a door hook that is snap-fitted with the buckle, the door hook is movable relative to the door body, and has a first position and a second position; when the door hook is snap-fitted with the buckle, the door hook is in the first position; when the door hook is moved from the first position to the second position, the door hook is separated from the buckle; and a switch assembly arranged on the box body and comprising a first button, a second button, and a blocking member; the blocking member being capable of being moved relative to the first button and/or the second button, and having a blocking position and an avoiding position; the first button being configured to drive the blocking member to move from the blocking position to the avoiding position, wherein the second button has an initial position and an opening position; when the blocking member is in the avoiding position, the second button is capable of being moved from the initial position to the opening position; the second button exerts force on the door hook and drives the door hook to move from the first position to the second position; and when the blocking member is in the blocking position, the blocking member is configured to prevent the second button from moving from the initial position to the opening position;

wherein the box body comprises a control box; the blocking member is provided with a first through hole through which the first button passes, and a second through hole through which the second button passes; a first pressing portion is arranged on a side of the first button;

when the first button passes through the first through hole, the first pressing portion contacts a hole wall of the first through hole, and exerts force on the blocking member, so that the blocking member is moved from the blocking position to the avoiding position;

when the blocking member is in the avoiding position, the second button is capable of passing through the second through hole, and exerting the force on the door hook, so that the door hook is moved from the first position to the second position; and when the blocking member is in the blocking position, the blocking member is configured to prevent the second button from passing through the second through hole;

wherein the control box is provided with a button groove; the first button comprises a first pressing plate and a first sliding rod; the second button comprises a second pressing plate and a second sliding rod;

the first pressing plate and the second pressing plate are both arranged in the button groove, and are capable of sliding in a depth direction of the button groove;

the second sliding rod is capable of extending through a rear wall of the button groove, and extending into the box body; and the blocking member is arranged on a wall of the button groove;

wherein guide holes are arranged on two opposite sidewalls of the button groove; two ends of the blocking member extend through two guide holes, respectively.

2. The cooking device according to claim 1, wherein the first pressing portion is arranged on a side of the first sliding rod, and a second pressing portion is arranged on a side of the second sliding rod;

when the blocking member is in the blocking position, the second pressing portion is not capable of passing through the second through hole;

when the blocking member is in the avoiding position, the second sliding rod and the second pressing portion are capable of passing through the second through hole, and the second sliding rod exerts force on the door hook and drives the door hook to move from the first position to the second position.

3. The cooking device according to claim 2, wherein the control box is further provided with a rotating member; a first stroke hole and a second stroke hole are arranged on the rear wall of the button groove; the first stroke hole and the second stroke hole are used in cooperation with the first sliding rod and the second sliding rod, respectively;

wherein the second sliding rod extends out of the second stroke hole and pushes the rotating member at a position of a maximum stroke, so that the rotating member directly or indirectly exerts force on the door hook, and drives the door hook to move from the first position to the second position.

4. The cooking device according to claim 3, wherein a first limiting portion and a second limiting portion are arranged on a sidewall of the button groove; the first limiting portion is configured to limit a stroke of the first pressing plate, and the second limiting portion is configured to limit a stroke of the second pressing plate.

5. The cooking device according to claim 3, wherein an abutting portion is arranged on a side of the first pressing plate close to the first sliding rod; the abutting portion is configured to contact a bottom surface of the button groove or the blocking member.

6. The cooking device according to claim 1, wherein the switch assembly further comprises a first elastic member; two ends of the first elastic member are respectively connected to the blocking member and the control box; the first elastic member is configured to move the blocking member from the avoiding position to the blocking position; the blocking member slidably cooperates with the control box; the blocking member is capable of reciprocating and translating relative to the control box between the blocking position and the avoiding position.

7. The cooking device according to claim 1, wherein a first sliding portion is arranged on a sidewall of the button groove, and a second sliding portion is arranged on the first pressing plate; one of the first sliding portion and the second sliding portion is a first guide rail, and the other of the first sliding portion and the second sliding portion is a first guide groove that slidably cooperates with the first guide rail.

8. The cooking device according to claim 1, wherein a third sliding portion is arranged on a sidewall of the button groove, and a fourth sliding portion is arranged on the second pressing plate; one of the third sliding portion and the fourth sliding portion is a second guide rail, and the other of the third sliding portion and the fourth sliding portion is a second guide groove that slidably cooperates with the second guide rail.

9. The cooking device according to claim 1, wherein a third through hole is arranged on the blocking member; a second hook portion is arranged on the second sliding rod; and the second hook portion is configured to be used in cooperation with the third through hole;

when the blocking member is in the blocking position and the second button is pressed, the second hook portion is inserted into the third through hole, to block the second button from moving from the initial position to the opening position; and when the blocking member is moved to the avoiding position, the second sliding rod and the second hook portion are capable of passing through the second through hole.

10. The cooking device according to claim 2, wherein the switch assembly further comprises a resilient member, wherein two ends of the resilient member abut against the first button and the control box, respectively; a first hook portion is arranged on the first pressing portion of the first button;

when the first button passes through the first through hole, the resilient member is pressed; after passing through the first through hole, the first hook portion abuts against a side surface of the blocking member under a restoring force of the resilient member, to stop the first button;

the second pressing portion is arranged on a side of the second button; when the second button is moved from the initial position to the opening position, and passes through the second through hole, the second pressing portion presses a hole wall of the second through hole, so that the blocking member is moved in a direction from the blocking position to the avoiding position; and when the first through hole is moved to a position opposite to the first hook portion, the blocking member releases stopping effect on the first button.

11. The cooking device according to claim 3, wherein the switch assembly further comprises a second elastic member; two ends of the second elastic member are connected to the door body and the door hook, respectively; the second elastic member is configured to move the door hook from the second position to the first position;

when the second button is moved from the initial position to the opening position, the second button pushes the rotating member to rotate; the rotating member directly or indirectly pushes the door hook to move from the first position to the second position.

12. A cooking device, comprising:

a box body provided with a buckle;

a door body rotatably connected to the box body, and wherein the door body is provided with a door hook that is snap-fitted with the buckle, the door hook is movable relative to the door body, and has a first position and a second position; when the door hook is snap-fitted with the buckle, the door hook is in the first position; when the door hook is moved from the first position to the second position, the door hook is separated from the buckle; and a switch assembly arranged on the box body and comprising a first button, a second button, and a blocking member; the blocking member being capable of being moved relative to the first button and/or the second button, and having a blocking position and an avoiding position; the first button being configured to drive the blocking member to move from the blocking position to the avoiding position, wherein the second button has an initial position and an opening position; when the blocking member is in the avoiding position, the second button is capable of being moved from the initial position to the opening position; the second button exerts force on the door hook and drives the door hook to move from the first position to the second position; and when the blocking member is in the blocking position, the blocking member is configured to prevent the second button from moving from the initial position to the opening position;

wherein the box body comprises a control box; the blocking member is provided with a first through hole through which the first button passes, and a second through hole through which the second button passes; a first pressing portion is arranged on a side of the first button;

when the first button passes through the first through hole, the first pressing portion contacts a hole wall of the first through hole, and exerts force on the blocking member, so that the blocking member is moved from the blocking position to the avoiding position;

when the blocking member is in the avoiding position, the second button is capable of passing through the second through hole, and exerting the force on the door hook, so that the door hook is moved from the first position to the second position; and when the blocking member is in the blocking position, the blocking member is configured to prevent the second button from passing through the second through hole;

wherein the control box is provided with a button groove; the first button comprises a first pressing plate and a first sliding rod; the second button comprises a second pressing plate and a second sliding rod;

the first pressing plate and the second pressing plate are both arranged in the button groove, and are capable of sliding in a depth direction of the button groove;

the second sliding rod is capable of extending through a rear wall of the button groove, and extending into the box body; and the blocking member is arranged on a wall of the button groove;

wherein the first pressing portion is arranged on a side of the first sliding rod, and a second pressing portion is arranged on a side of the second sliding rod;

when the blocking member is in the blocking position, the second pressing portion is not capable of passing through the second through hole;

when the blocking member is in the avoiding position, the second sliding rod and the second pressing portion are capable of passing through the second through hole, and the second sliding rod exerts force on the door hook and drives the door hook to move from the first position to the second position.

13. The cooking device according to claim 12, wherein the control box is further provided with a rotating member; a first stroke hole and a second stroke hole are arranged on the rear wall of the button groove; the first stroke hole and the second stroke hole are used in cooperation with the first sliding rod and the second sliding rod, respectively;

wherein the second sliding rod extends out of the second stroke hole and pushes the rotating member at a position of a maximum stroke, so that the rotating member directly or indirectly exerts force on the door hook, and drives the door hook to move from the first position to the second position.

14. The cooking device according to claim 13, wherein a first limiting portion and a second limiting portion are arranged on a sidewall of the button groove; the first limiting portion is configured to limit a stroke of the first pressing plate, and the second limiting portion is configured to limit a stroke of the second pressing plate.

15. The cooking device according to claim 13, wherein an abutting portion is arranged on a side of the first pressing plate close to the first sliding rod; the abutting portion is configured to contact a bottom surface of the button groove or the blocking member.

16. The cooking device according to claim 12, wherein the switch assembly further comprises a resilient member, wherein two ends of the resilient member abut against the first button and the control box, respectively; a first hook portion is arranged on the first pressing portion of the first button;

when the first button passes through the first through hole, the resilient member is pressed; after passing through the first through hole, the first hook portion abuts against a side surface of the blocking member under a restoring force of the resilient member, to stop the first button;

the second pressing portion is arranged on a side of the second button; when the second button is moved from the initial position to the opening position, and passes through the second through hole, the second pressing portion presses a hole wall of the second through hole, so that the blocking member is moved in a direction from the blocking position to the avoiding position; and when the first through hole is moved to a position opposite to the first hook portion, the blocking member releases stopping effect on the first button.

17. The cooking device according to claim 13, wherein the switch assembly further comprises a second elastic member; two ends of the second elastic member are connected to the door body and the door hook, respectively; the second elastic member is configured to move the door hook from the second position to the first position;

when the second button is moved from the initial position to the opening position, the second button pushes the rotating member to rotate; the rotating member directly or indirectly pushes the door hook to move from the first position to the second position.

18. A cooking device, comprising:

a box body provided with a buckle;

a door body rotatably connected to the box body, and wherein the door body is provided with a door hook that is snap-fitted with the buckle, the door hook is movable relative to the door body, and has a first position and a second position; when the door hook is snap-fitted with the buckle, the door hook is in the first position; when the door hook is moved from the first position to the second position, the door hook is separated from the buckle; and a switch assembly arranged on the box body and comprising a first button, a second button, and a blocking member; the blocking member being capable of being moved relative to the first button and/or the second button, and having a blocking position and an avoiding position; the first button being configured to drive the blocking member to move from the blocking position to the avoiding position, wherein the second button has an initial position and an opening position; when the blocking member is in the avoiding position, the second button is capable of being moved from the initial position to the opening position; the second button exerts force on the door hook and drives the door hook to move from the first position to the second position; and when the blocking member is in the blocking position, the blocking member is configured to prevent the second button from moving from the initial position to the opening position;

wherein the box body comprises a control box; the blocking member is provided with a first through hole through which the first button passes, and a second through hole through which the second button passes; a first pressing portion is arranged on a side of the first button;

when the first button passes through the first through hole, the first pressing portion contacts a hole wall of the first through hole, and exerts force on the blocking member, so that the blocking member is moved from the blocking position to the avoiding position;

when the blocking member is in the avoiding position, the second button is capable of passing through the second through hole, and exerting the force on the door hook, so that the door hook is moved from the first position to the second position; and when the blocking member is in the blocking position, the blocking member is configured to prevent the second button from passing through the second through hole;

wherein the control box is provided with a button groove; the first button comprises a first pressing plate and a first sliding rod; the second button comprises a second pressing plate and a second sliding rod;

the first pressing plate and the second pressing plate are both arranged in the button groove, and are capable of sliding in a depth direction of the button groove;

the second sliding rod is capable of extending through a rear wall of the button groove, and extending into the box body; and the blocking member is arranged on a wall of the button groove;

wherein a third through hole is arranged on the blocking member; a second hook portion is arranged on the second sliding rod; and the second hook portion is configured to be used in cooperation with the third through hole;

when the blocking member is in the blocking position and the second button is pressed, the second hook portion is inserted into the third through hole, to block the second button from moving from the initial position to the opening position; and when the blocking member is moved to the avoiding position, the second sliding rod and the second hook portion are capable of passing through the second through hole.

* * * * *